United States Patent [19]

McCartney

[11] 4,372,523

[45] Feb. 8, 1983

[54] ICE MAKING CONTAINER APPARATUS

[76] Inventor: Billy R. McCartney, 8305 Londonderry, Dallas, Tex. 75228

[21] Appl. No.: 69,265

[22] Filed: Aug. 24, 1979

[51] Int. Cl.[3] ..... B28B 7/34; F25C 1/04

[52] U.S. Cl. ..... 249/79; 220/400; 249/121; 249/133; 249/139

[58] Field of Search ..... 249/79, 81, 133, 139, 249/121

[56] References Cited

U.S. PATENT DOCUMENTS

| | | | |
|---|---|---|---|
| 657,610 | 9/1900 | Mitchell | 249/79 |
| 1,804,324 | 5/1931 | De Weal | 249/133 |
| 1,825,916 | 10/1931 | Mock | 249/121 |
| 1,849,457 | 3/1932 | Johns | 249/81 |
| 2,637,668 | 5/1953 | Eftihios | 249/81 |
| 2,712,224 | 7/1955 | Roethel | 249/139 |
| 2,744,391 | 5/1956 | Deane | 249/79 |
| 3,680,828 | 8/1972 | Swett | 249/121 |
| 4,023,768 | 5/1977 | Casasus | 249/81 |

*Primary Examiner*—John C. Bleutge
*Assistant Examiner*—Arthur H. Koeckert
*Attorney, Agent, or Firm*—Hubbard, Thurman, Turner & Tucker

[57] ABSTRACT

Portable ice making container apparatus is provided for making blocks of ice. An inner container is used to receive water which is to be frozen to form a block of ice. A larger outer container is provided to receive and support the inner container therein. Support posts are provided at the bottom of the outer container to position the bottom of the inner container a short space above the bottom of the outer container. Flanges are disposed at the tops of both containers to interconnect the containers for the purpose of maintaining them in a nested, spaced-apart relationship. A cover member has walls constructed to fit snugly against the walls of the inner container to enclose the top of the inner container. The walls extend downward to a common bottom to form a recess for containing fluid to warm the bottom of the cover member. The outer container includes receptacles at the corners for receiving fluid to be dispersed throughout the space between the inner and outer containers. The cover member also includes spout members at the corners extending partially over the receptacle members for directing warm fluid from the cover into the receptacles.

4 Claims, 5 Drawing Figures

ICE MAKING CONTAINER APPARATUS

BACKGROUND AND SUMMARY OF THE INVENTION

The present invention relates to apparatus for making ice. More particularly, the present invention concerns ice making apparatus for producing a removable ice block.

In many uses of ice, it is preferable to have one or more large blocks of ice as opposed to smaller ice cubes or ice chips. One advantage of such an ice block is that it melts much more slowly than ice cubes thus providing a cool temperature for a longer period of time. Ice blocks are especially desirable for recreational uses such as camping and outings.

Most systems for producing ice blocks involve complicated commercial apparatus which is too expensive and bulky for home use. U.S. Pat. Nos. 2,113,359 and 3,274,794 disclose complex apparatus for commercially producing ice blocks in molds. Such systems require commercial apparatus which is essentially not portable except with the use of a truck or other vehicle and which necessitates the use of large brine tanks and other bulky apparatus.

The present invention provides a simple ice making container which can be portably used in the home to quickly and easily provide a medium-sized ice block for a variety of uses. The system utilizes a first container for receiving water to be frozen to form the ice block. A second container which is larger than the first container receives the first container in a nested relationship. A support is provided between the walls of the first and second container to form a space between those walls. A receptacle in the wall of the outer container receives warm fluid into the space to warm the walls of the first container and enable the removal of the ice block. A cover member fits over the top of the walls of the first container so that the first container is fully enclosed.

In another embodiment, a fastening means extends between the walls of the first and second container to maintain the two containers in a nested relationship. The cover member includes a recessed portion extending over substantially the entire cover member to receive warm fluid and includes a spout member extending from the cover member into the receptacle of the outer container.

Using this invention, one fills the inner container and places the inner and outer containers in a nesting relationship with the cover member thereon in a home freezer. Once the ice block has frozen in the inner container, warm water is poured into the recess of the cover from which it runs through the spout to the receptacle means in the walls of the outer container. Alternatively, the warm fluid can be poured directly into the receptacles. The fluid warms the walls of the cover member and the inner container so that the cover can be easily removed and the ice block can be easily separated from the inner container.

As can be seen, the present invention provides several advantages over the prior art. First the ice making apparatus is relatively small and portable and can be easily stored in a nested arrangement. The apparatus is preferably small enough to be stored in a home freezer. Essentially no maintenance or upkeep is required. The construction of the containers and cover member enable the easy introduction of warm fluid onto the cover and between the walls so as to enable the removal of the ice block from the apparatus. Moreover, the ice making apparatus is relatively inexpensive to manufacture, being designed for injection molding.

Other objects, advantages and features of the present invention will be set forth in the following detailed description, taken in conjunction with drawings, wherein.

Figure 1:
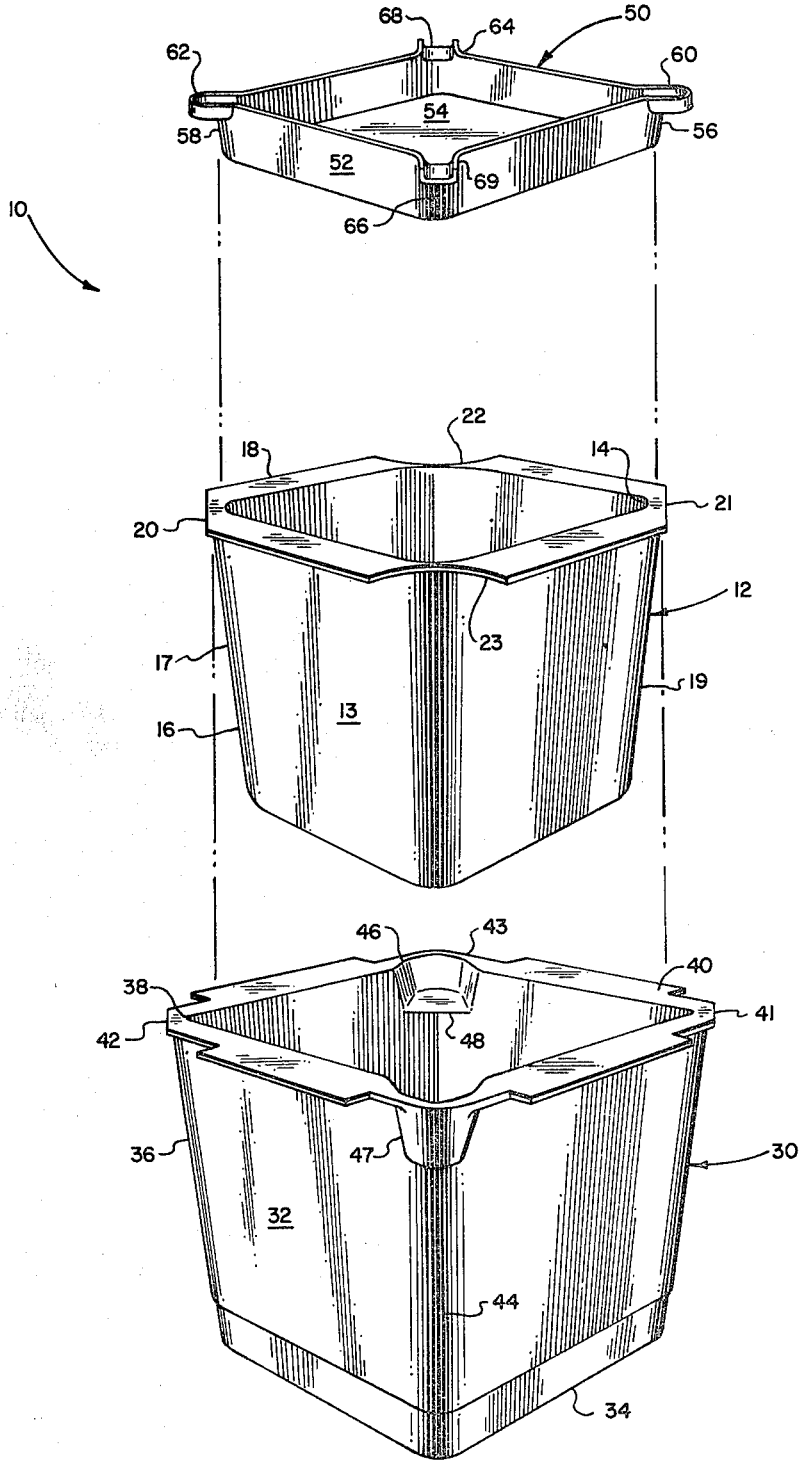
FIG. 1 is a perspective exploded view of the ice making container of the present invention.

Referring now to FIG. 1, the ice making apparatus 10 of the present invention includes three nestable container members. An inner container 12 has rectangularly shaped walls which slant slightly inwardly toward the bottom of the container. Both the inside corners 14 and the outside corners 16 are preferably rounded. About the upper rim of the container a flange 18 extends outwardly from the container substantially perpendicular to the walls 13. Flange 18 preferably forms stub corners 20 and 21 substantially flush with the container walls 13 at two opposing corners 17 and 19 and is cut in an arcuate form 22 and 23 at the other two opposing corners.

An outer container 30 has a rectangular cross-section slightly larger than that of inner container 12 so that container 12 can be nestably disposed therein. The walls 32 of container 30 are likewise rectangularly shaped and slant slightly inward and downward to the base 34. The outer corners 36 of container 30 are slightly rounded while the inner corners 38 preferably form 90 degree angles. A flange 40 extends outwardly substantially perpendicular to the walls 32 of container 30. The flange is stubbed off at two opposing corners 41 and 42 and is arcuately formed to curve outwardly about the two other opposing corners 43 and 44.

Receptacles 46 and 47 are disposed at the other two opposing corners 43 and 44. The receptacles are preferably outward flaring from walls 32 and have an opening at the top thereof in flange 40 for receiving warm fluid therein. The base 48 of receptacle 46 slants downward to open into the inner cavity of container 30. The base of receptacle 47 is identically constructed.

A cover member 50 is provided to be positioned at the top of container 12 to enclose the top of the container. Cover member 50 preferably has a rectangularly shaped cross-section with four identical walls 52 extending a short distance downward to join at a common bottom wall 54, thus forming a shallow recess 55 about substantially the entire surface of cover member 50. At the top of each of two opposing corners 56 and 58 are disposed oval handles 60 and 62 extending outward for easy gripping to remove the cover member 50. At opposing corners 64 and 66 are disposed outwardly extending spouts 68 and 69 which open into the top of recess 54.

Figure 2:
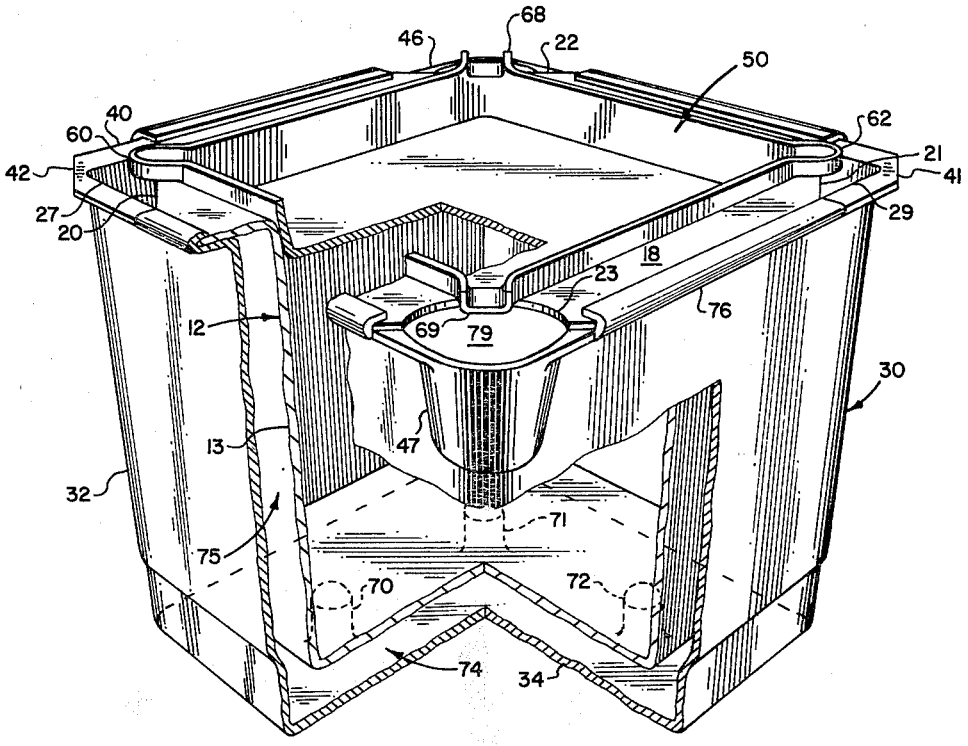
FIG. 2 is a corner perspective partially cut-away view of the apparatus of claim 1 in a nested relationship.

Looking now at FIG. 2, the members of the ice making container of the present invention are shown in a nested relationship. Container 12 is positioned within container 30 with the side and bottom walls spaced a short distance therefrom. Container 12 rests on three posts 70, 71 and 72 extending upward from the bottom 34 of container 30. These supports position container 12 slightly above container 30 to form a space 74 therebetween.

Similarly, the outward extending flange 18 of container 12 rests on flange 40 of container 30 which has been crimped in a U-shaped form 76 over flange 18 to secure the flange and thereby secure the container 12 in a nested relationship with container 30. Form 76 thus connects outer container 30 to inner container 12 so as to prevent movement of container 12 away from container 30 in a longitudinal direction shown approximately by the dotted lines in FIG. 1. The engagement of flange 18 by crimped flange 40 provides a space 75 between walls 13 of inner container 12 and walls 32 of outer container 30 about the entire perimeter of the two containers.

The arcuate portions 22 and 23 of flange 18 curve about the rim of receptacles 46 and 47 to leave ports or openings 78 and 79 at the top of the receptacles for the introduction of fluid. The spout members 68 and 69 extend partially over the port openings 78 and 79 to enable the introduction of warm fluid from those spouts into the port openings.

Stubbed ends 20 and 21 of flange 18 cut across opposing stubbed corners 40 and 41 of outer container 30 to leave triangular-shaped ports 27 and 29 opening into container 30. Handles 60 and 62 of cover member 50 extend beyond the stubbed ends 20 and 21 of inner container 12 to partially overhand the ports 27 and 29 between the stubbed ends 20 and 21 of flange 18 and the stubbed corners 40 and 41 of container 30. Handles 60 and 62 are thereby easily gripped for the removal of cover member 50.

Figure 3:
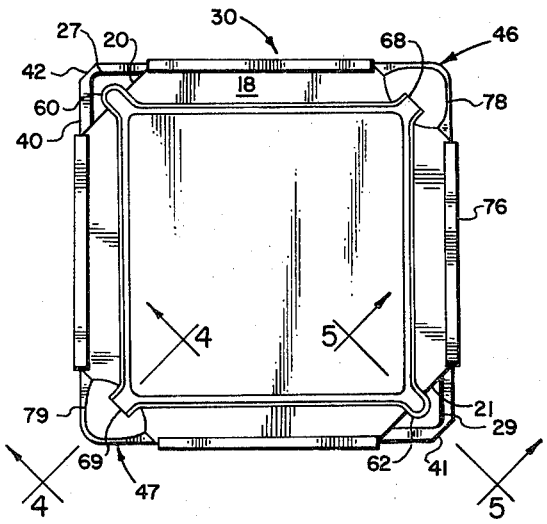
FIG. 3 is a top plan view of the ice making apparatus of FIG. 2.

Referring now to FIG. 3, a top view is shown of the container apparatus of FIG. 2. As shown, the inner flange 18 of inner container 12 is engaged by the crimped or rolled edge 76 of outer flange 40 around the entire perimeter of outer container 30 except for the corners. It can be seen that spouts 68 and 69 extend partially over the receptacles 46 and 47. Handles 60 and 62 extend past stubbed corners 20 and 21 to project partially over openings 27 and 29 leading to space 75 between the containers. The projection of these handles beyond the underlying flange 18 enables gripping of the handles so as to remove the cover 50 from the top of container 12.

Figure 4:
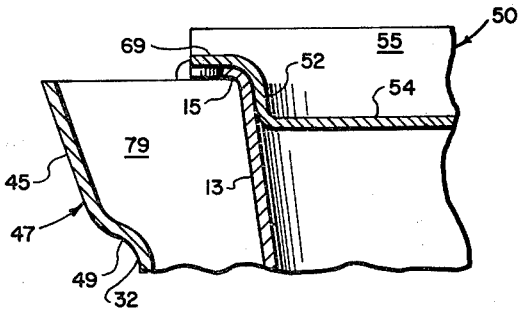
FIG. 4 is a partial cross-sectional view of a corner of the ice making apparatus of FIG. 3.

Looking now at FIG. 4, the corners of containers 12 and 30 and cover 50 are shown in cross-section. As shown therein, the receptacle wall 32 of outer container 30 projects sharply outward in a flared portion 49 and then extends upwards and slightly outward in a basin wall 45 to form receptacle 47. This construction extends the wall 32 of container 30 at the corner outward to provide an enlarged receptacle 47 having an opening 78 to receive fluid therein.

Also shown in FIG. 4, the wall 13 of inner container 12 extends upwards and is slightly curled outward at the tip 15 which forms arcuate shape 23. Spout 69 partially overlaps receptacle 79. The wall 52 of cover member 50 engages wall 13 of inner container 12 to provide a snug fit. The bottom 54 of cover member 50 extends horizontally away from the bottom of wall 52 to form a recess 55 for holding fluid.

Figure 5:
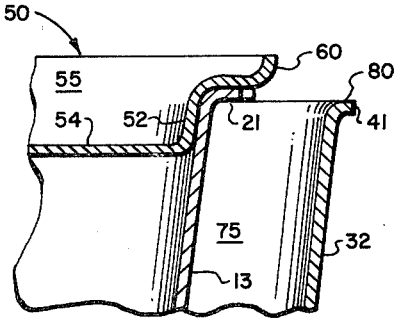
FIG. 5 is a partial cross-sectional view of another corner of the ice making apparatus of FIG. 3.

With reference to FIG. 5, similar construction is provided with regard to the other two corners of the container shown in FIG. 3. The wall 32 of outer container 30 extends upward and outward to end in an outwardly extending tip 80 to form stubbed end 41. Wall 32 of outer container 30 and wall 13 of inner container are separated to provide space 75. The inner wall 52 of cover member 50 fits snuggly against wall 13 and curls above the outwardly extending tip of wall 13 to form handle 60. Bottom wall 54 of cover member 50 extends substantially horizontally at the bottom of wall 52 to form recess 55 for containing fluid.

In operation, the inner container is nested on posts 70, 71 and 72 within the outer container as shown in FIG. 2 and the flange 40 of outer container 30 is curled about flange 18 of inner container 13 to hold the two containers together. Water is then poured into the inner container 12 until it has reached a desired level. The cover member 50 is then securely fastened over the top of inner container 12 and the unit is placed in a low temperature environment such as a home freezer.

After the ice has frozen, the unit is removed and warm fluid is poured into receptacles 46 and 47 sufficient to fill spaces 74 and 75 between the two containers. Fluid is also preferably poured into the recessed area 55 of cover member 50 so that the bottom 54 is also warmed. After a few moments, cover member 50 may be removed and the water poured therefrom. The water is also removed from the spaces 74 and 75 between the inner and outer containers which are inverted to allow the ice block within the inner container to be removed therefrom.

Although a preferred embodiment of the preferred invention has been shown and described, it is understood that obvious modifications, deletions and additions may be made to the embodiment shown without departing from the scope of the present invention. For example the outer container may have one or move receptacles located at different positions or shaped differently than that shown. Also, the construction and appearance of the containers and cover members may be different from that shown. It is contemplated that these and other obvious modifications fall within the scope of the present invention.

What is claimed is:

1. Ice making apparatus for producing a removable ice block comprising:

a first container for receiving water to be frozen in the form of said ice block;

a second container larger than said first container for receiving said first container;

support means between the walls of said first and second containers for spacing said first container from said second container to form a space between the walls of said first and second containers;

receptacle means in the wall of said second container for receiving warm fluid into said space to warm the walls of the first container and enable removal of said ice block therefrom; and a cover member having means for engaging the walls of said first container to enclose the top of said first container, said cover member including spout means opening toward said receptacle means for directing the warm fluid into said receptacle means.

2. Ice making apparatus for producing a removable ice block comprising:

a first container for receiving water to be frozen in the form of said ice block;

a second container larger than said first container for receiving said first container in a nested relationship with said second container;

support means between the walls of said first and second containers for separating said first container from said second container to form a space between the walls of said first and second containers;

connecting means for engaging the walls of said first and second containers to prevent movement of said first container in a longitudinal direction away from said second container to thereby maintain said first container in a nested relationship with said second container;

port means in the wall of said second container for receiving warm fluid into said space to warm the walls of the first container and enable removal of said ice block therefrom; and a cover member having means for engaging the walls of said first container to enclose the top of said first container, said cover member including spout means opening toward said port means for directing the warm fluid into said port means.

3. Ice making apparatus for producing a removable ice block comprising:

an inner container for receiving water to be frozen to form said block;

an outer container having a cross-section greater than said inner container for nestably receiving said inner container;

spacing means extending between the side and bottom walls of the inner and outer containers to separate said containers and thereby form a space between said inner and outer containers with said containers in a nested spaced-apart relationship;

means for extending between the walls of said inner and outer containers for connecting said inner and outer containers together in said nested, spaced-apart relationship;

port means for receiving warm fluid and directing said fluid into said space to warm the walls of said inner container and enable removal of said ice block therefrom; and a cover member having walls extending to engage the walls of said inner container, said cover member having spout means extending toward said port means for directing warm fluid into said port means.

4. Ice making apparatus for producing a removable ice block comprising:

a first container for receiving water to be frozen in the form of said ice block;

a second container larger than said first container for receiving said first container in a nested relationship with said second container;

support means between the walls of said first and second containers for separating said first container from said second container to form a space between the walls of said first and second containers;

connecting means for engaging the walls of said first and second containers to maintain said first container in a nested relationship with said second container;

port means in the wall of said second container for receiving warm fluid into said space to warm the walls of the first container and enable removal of said ice block therefrom; and a cover member having means for engaging the walls of said first container to enclose the top of said first container, wherein said cover member includes spout means opening toward said port means for directing the warm fluid into said port means.

* * * * *